US005557586A

United States Patent [19]

McCuan et al.

[11] Patent Number: 5,557,586

[45] Date of Patent: Sep. 17, 1996

[54] UNITARY CLOCK AND PICTURE FRAME

[76] Inventors: Velvet J. McCuan; Gene A. McCuan, both of 8045 N. Hwy. 97, Sp. 13, Terrebonne, Oreg. 97760

[21] Appl. No.: 369,721

[22] Filed: Jan. 6, 1995

[51] Int. Cl.[6] ..... G04B 19/04

[52] U.S. Cl. ..... 368/80; 368/223; 368/228

[58] Field of Search ..... 368/80, 223–233, 368/10, 276

[56] References Cited

U.S. PATENT DOCUMENTS

| | | | |
|---|---|---|---|
| 3,890,777 | 6/1975 | Stanish | 368/77 |
| 5,022,016 | 6/1991 | Smith et al. | 368/223 |
| 5,216,642 | 6/1993 | Rikkers | 368/10 |

FOREIGN PATENT DOCUMENTS

| | | | |
|---|---|---|---|
| 2296878 | 7/1976 | France | 368/234 |
| 2461969 | 3/1981 | France | 368/276 |

*Primary Examiner*—Bernard Roskoski
*Attorney, Agent, or Firm*—Robert E. Howard

[57] ABSTRACT

A unitary clock and picture frame. The clock and the area for receiving the picture occupy the same space within the frame. The clock movement housing is located between a transparent front panel and a rear panel of the frame. A drive stem assembly for receiving hand members extends outwardly from the movement housing through an opening in the transparent front panel, and hand members are attached to the outer portion of the drive stem assembly. Non-numeric hour indicia forming a clock face are located on said transparent front panel and have a configuration such that they continue to constitute a readable clock face when the transparent front panel is either rotated, reversed, or both rotated and reversed, thereby permitting the clock face to be located at any one of several predetermined locations depending upon its relationship to a picture to be inserted into the frame.

5 Claims, 1 Drawing Sheet

UNITARY CLOCK AND PICTURE FRAME

BACKGROUND OF THE INVENTION

This invention relates to a unitary clock and picture frame. More particularly, the invention relates to a unitary clock and picture frame wherein the clock and picture are located in the same space within the frame and the clock is easily movable to any one of several predetermined locations.

A number of references show a combination clock and picture frame where the clock and picture are located separately adjacent each other, i.e., the clock is located on one side of the frame and the picture on the other side of the frame, or the two are located in separate but adjoining frames. Exemplary of such references are U.S. Pat. Nos. Des. 346,966, Des. 347,580 and Des. 333,271.

SUMMARY OF THE INVENTION

It is an object of this invention to provide a unitary clock and picture frame wherein the clock and picture occupy the same space within the frame. It is a further object of this invention to provide a unitary clock and picture frame wherein the clock is movable to any one of several predetermined locations depending upon aesthetic considerations involving the picture to be placed in the frame and its relationship to the clock.

These and other objects are achieved by: (1) providing a frame having a transparent front panel located within the front portion of the frame and a rear panel located at the rear portion of the frame; and (2) providing a clock comprising a movement housing located within the frame between the front and rear panels, a stem extending from the movement housing and through an opening in the transparent front panel, hand members operably attached in a timekeeping manner to the stem, non-numeric hour indicia forming a clock face located on the transparent front panel in timekeeping alignment with the hands, the non-numeric hour indicia being of such a configuration that they continue to constitute a readable clock face when the transparent front panel is either rotated or reversed, or both rotated and reversed, so long as one of said indicia is located in the twelve o'clock position.

DESCRIPTION OF THE PREFERRED EMBODIMENTS

Figure 1:
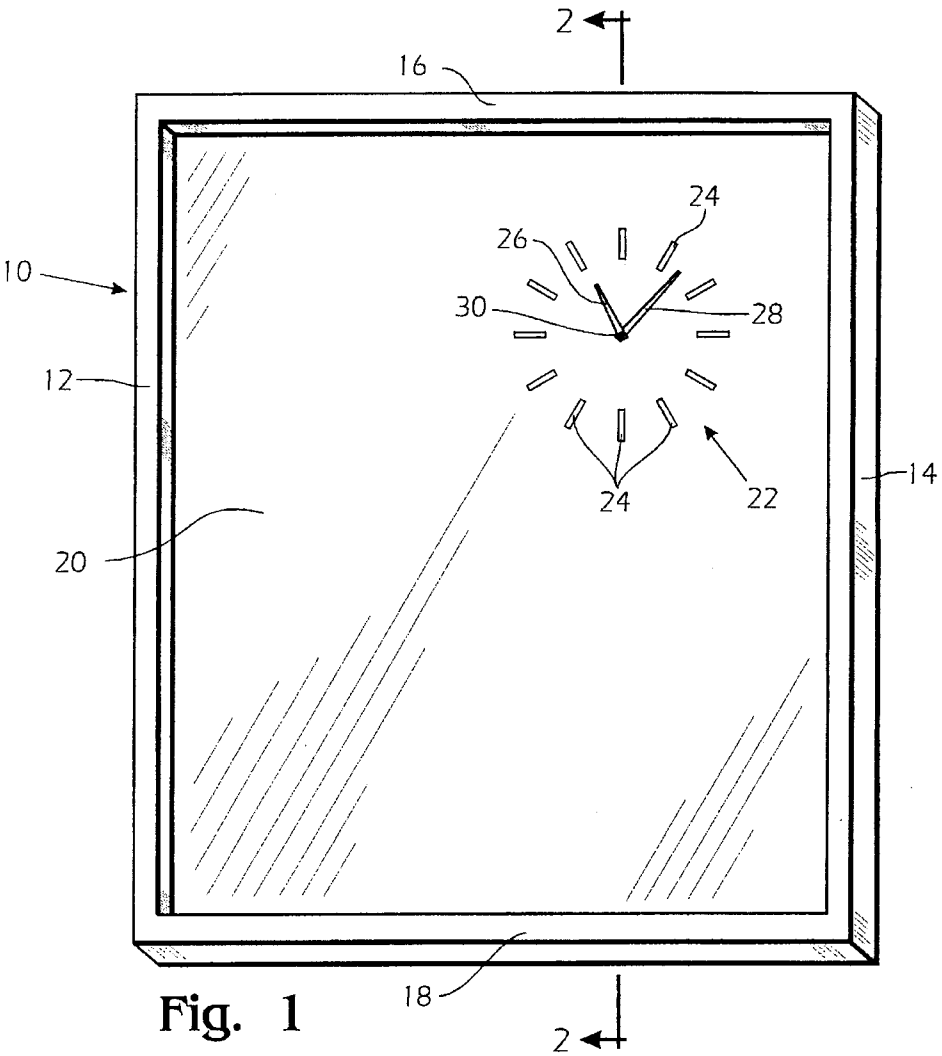
FIG. 1 is a front view of the unitary clock and picture frame of this invention.

FIG. 1 is a frontal view of the unitary clock and picture frame of this invention. As illustrated, the frame 10 is comprised of two vertical frame members 12 and 14, and two horizontal frame members 16 and 18, the vertical and horizontal frame members 12, 14, 16 and 18 being fastened together at their intersections in any conventional manner to provide an enclosed rectangular open space. Alternatively, frame members 12, 14, 16 and 18 can all comprise parts of a single piece made by injection molding, etc.

A rectangular transparent front panel 20 occupies the front portion of the open space created by frame members 12, 14, 16 and 18. Transparent front panel 20 has an outer planar surface 21 and an inner planar surface 23.

A clock 22 is shown as being located in the upper right quadrant of the transparent front panel 20. A plurality of universal indicia 24 representing the hours form the clock face. Universal indicia 24 may number twelve, one for each hour, or some lesser number that still allows an observer to tell the time.

By "universal" indicia 24 it is meant that indicia 24 are non-numeric indicia having a configuration such that they still accurately represents the hours even when the transparent front panel 20 containing the clock face is rotated or reversed, or both rotated and reversed, so long as one of the indicia is positioned at the twelve o'clock location. For example, if the transparent front panel 20 containing the clock face is rotated 90 degrees clockwise, what had been the nine o'clock indicia becomes the twelve o'clock indicia. Non-numeric indicia 24 are illustrated in FIG. 1 as being bars; other universal indicia configurations can readily be envisioned by the skilled artisan.

The clock 22 also has hand members, including an hour hand 26 and a minute hand 28, mounted on the outer portion of a drive stem assembly 30 in a manner well known to those in the clock art. Because it is not part of the present invention, but conventional in the clock art, the drive stem assembly 30 is not shown in detail, but would typically be comprised of a fixed, outer tube, a smaller diameter hour hand tubular stem inside the fixed outer tube, and a still smaller diameter tubular minute hand stem inside the hour hand tubular stem, the minute hand being driven by the drive mechanism contained in movement housing 34 and the hour hand being driven by gearing operating between the minute and hour hand tubular stems. The drive stem assembly 30 shown in FIG. 2 actually depicts only the fixed, outer tube of the assembly. The hour and minute hands are affixed to their respective tubular stems by conventional means, such as press fitting or threading the tubular stem and attaching the hand with a nut.

Figure 2:
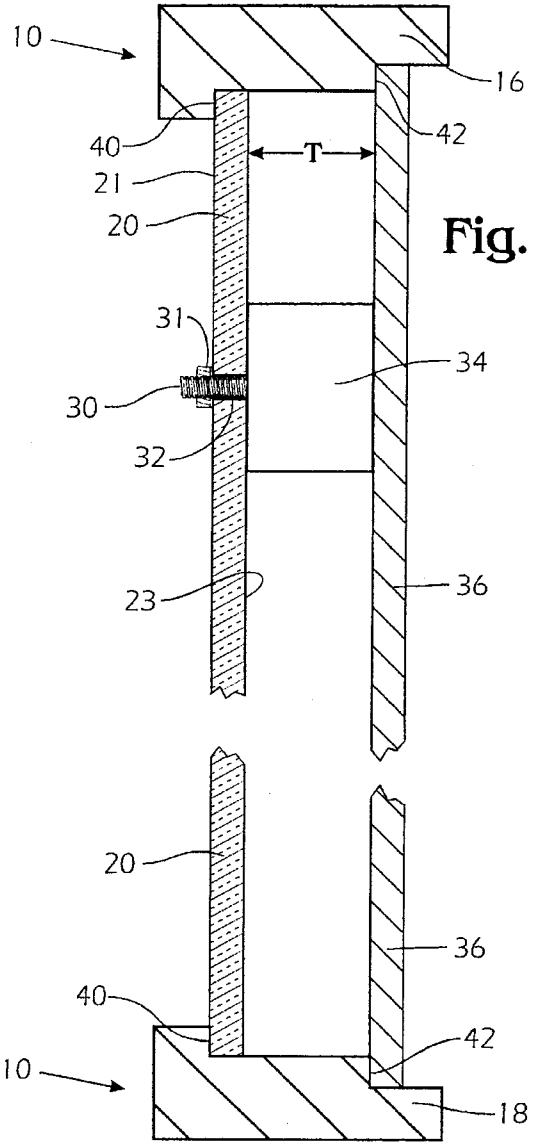
FIG. 2 is a side view in cross section of the unitary clock and picture frame of this invention taken along line 2—2 of FIG. 1.

Referring now to FIG. 2, it can be seen that drive stem assembly 30 extends through an opening 32 formed through transparent front panel 20. Opening 32 is, preferably, only slightly larger than drive stem assembly 30 to provide a snug fit. Drive stem assembly 30 and movement housing 34 are held firmly to transparent front panel 20 by a washer and nut assembly 31 screwed onto a threaded portion of drive stem assembly 30 extending beyond the front planar surface 21 of transparent front panel 20.

The clock driving movement mechanism (not shown) is located within movement housing 34 which is located behind transparent front panel 20 and in front of rear panel 36. It is preferred that the clock driving mechanism located within movement housing 34 be battery powered, the battery being also located within housing 34, but the clock may be driven by any other conventional mechanical or electrical means.

Rear panel 36 may abut housing 34 in order to hold, or assist in holding, transparent front panel 20 in place in the frame, but transparent front panel 20 may be independently held in place within the front portion of frame 10 by glazer's nails or other suitable fastening means.

In FIG. 2 it can be seen that the cross section of frame member 16, which is identical to the cross section of frame members 12, 14 and 18, is such as to provide a front ledge 40 and a rear ledge 42 to seat the transparent front panel 20 and the rear panel 36, respectively. Rear panel 36 may be held in place within the rear portion of frame 10 by glazer's nails or other suitable fastening means.

It can also be seen in FIG. 2 that the dimension "T" (i.e., the distance between inner planar surface 23 of transparent front panel 20 and rear panel 36) is such as to provide adequate space for incorporating movement housing 34 between transparent front panel 20 and rear panel 36.

As mentioned above, clock 22 is easily movable to any one of several locations within the frame 10. This can be accomplished in one of several ways.

One way of relocating the clock involves rotating the entire frame so that the shorter frame members 16 and 18 are located vertically instead of horizontally as shown in FIG. 1. For example, if the frame and clock as shown in FIG. 1 are rotated counterclockwise 90 degrees, the clock will be located in the upper left quadrant instead of in the upper right quadrant, as shown in FIG. 1. If the frame and clock shown in FIG. 1 are rotated clockwise 90 degrees, the clock will be located in the lower right quadrant.

Another way of relocating the clock is to leave the shorter members 16 and 18 as the horizontal members, but rotate the frame 180 degrees so that frame member 16 becomes the bottom horizontal frame member and frame member 18 becomes the top horizontal frame member. If rotated 180 degrees clockwise or counterclockwise, the clock will be in the lower left hand quadrant.

The third way of relocating the clock can involve either of the other two methods discussed above, but additionally involves reversing the transparent front panel 20 so that what was originally the outer planar face 21 becomes the inner planar face 23, and vice versa.

Thus, it can be seen that the clock may be located in any of the four quadrants of the frame in either the position where the shorter frame members 16 and 18 are vertically disposed or where they are horizontally disposed. It can also be seen that universal non-numeric hour indicia is required in order to be able to locate the clock in any of the four quadrants and still have a clock face that is understandable to the observer.

Although not shown, a picture is inserted into the frame in back of the transparent front panel 20 in the usual way. If it is desired to have the picture intrude into the area where the clock is located, a hole is punched in the picture at the location of the opening 32 in transparent front panel 20, and the drive stem assembly 30 inserted therethrough upon assembly of the clock and picture frame combination.

The transparent front panel 20 may be formed of glass, plexiglass or any other transparent material normally used in picture frame construction. Rear panel 36 may be formed of any conventional rear panel picture frame material, including cardboard or other thin board material.

The universal indicia 24 may be marked on transparent front panel 20 in any number of ways, such as etching, painting, printing, laminating, etc. The configuration of the universal indicia 24 and the method of applying the indicia to the transparent front panel 20 should be chosen so as to balance the need for readily readable universal indicia 24 and the need to maximize the viewing area of the picture to be inserted into the frame. The universal indicia 24 may be located on either the outer planar surface 21 or the inner planar surface 23 of transparent front panel 20, or, in registration, on both outer and inner planar surfaces 21 and 23, respectively.

Frame 10 may be constructed of any conventional picture frame material, such as wood, plastic, metal, etc. The assembled frame 10 and its rear panel 36 may be configured so that the frame can be hung on a wall or placed upright on a piece of furniture, such configurations being well known in the art.

Although in the preferred embodiment discussed above the frame 10 is described as being "rectangular" in shape, it is intended that square shapes be included as being rectangular in shape. Shapes other than rectangular may also be used, including oval or circular shapes.

We claim:

1. A unitary clock and picture frame assembly wherein said clock and the area of said frame for receiving a picture occupy the same space within the frame and the clock is movable to any one of several predetermined locations within the frame, said frame assembly comprising a frame member or members enclosing said space for said picture and said clock, said frame having a removable transparent front panel located in the front portion of said frame and a removable rear panel located in the rear portion of said frame, said removable transparent front panel having an outer planar face and an inner planar face, said inner planar face of said removable transparent front panel being adapted to receive a picture, said clock comprising a movement housing attached to said transparent front panel, said movement housing being located entirely within said frame and between said removable transparent front panel and said removable rear panel, said movement housing having a drive stem assembly extending outwardly therefrom, said removable transparent front panel having an opening extending therethrough for receiving said drive stem assembly, the outer end of said stem extending through said opening and beyond the outer planar face of said removable transparent front panel, hand members located on the outer portion of said drive stem assembly and beyond the outer planar face of said removable transparent front panel, and non-numeric hour indicia forming a clock face located on said removable transparent front panel in an off-center location and in timekeeping alignment with said hand members, said non-numeric hour indicia being of such a configuration that they continue to constitute a readable clock face when said transparent front panel is either rotated, removed and reversed, or both rotated and reversed, to a position such that one of said non-numeric indicia is located in the twelve o'clock position.

2. The unitary clock and picture frame assembly of claim 1 wherein said non-numeric indicia are bars.

3. The unitary clock and picture frame assembly of claim 1 wherein the shape of said frame is a rectangle having four quadrants, said clock face being located wholly within one of said four quadrants.

4. The unitary clock and picture frame assembly of claim 1 including a picture located adjacent the inner planar face of said removable transparent front panel.

5. The unitary clock and picture frame assembly of claim 4 wherein said picture extends into the area occupied by said clock face.

* * * * *